United States Patent [19]

Dawson

[11] 4,265,643

[45] May 5, 1981

[54] AIR PURIFIER

[76] Inventor: Edward S. Dawson, 2927 Hillsboro Ave, North, Minneapolis, Minn. 55427

[21] Appl. No.: 19,070

[22] Filed: Mar. 9, 1979

Related U.S. Application Data

[63] Continuation-in-part of Ser. No. 840,915, Oct. 11, 1977, abandoned.

[51] Int. Cl.[3] ..... B03C 3/12; B03C 3/36; B03C 3/45

[52] U.S. Cl. ..... 55/130; 55/133; 55/138; 55/154; 55/437; 55/463; 55/473

[58] Field of Search ..... 55/128, 130–131, 55/133, 138, 142, 154, 413–414, 463, 437, 473

[56] References Cited

U.S. PATENT DOCUMENTS

| | | | |
|---|---|---|---|
| 276,716 | 5/1883 | Ritchie | 55/463 X |
| 752,481 | 2/1904 | Thode | 55/463 X |
| 2,397,197 | 3/1946 | Newman | 55/473 X |
| 2,498,342 | 2/1950 | Petticrew | 55/473 X |
| 2,565,458 | 8/1951 | Weisz | 55/142 |
| 2,700,362 | 1/1955 | Calling | 55/473 X |
| 2,776,724 | 1/1957 | Goldschmied | 55/138 X |
| 2,871,974 | 2/1959 | Werst | 55/137 X |
| 2,873,000 | 2/1959 | Elam | 55/138 |
| 2,973,054 | 2/1961 | Kurtz | 55/131 |
| 2,989,144 | 6/1961 | Styrie | 55/138 X |
| 3,104,963 | 9/1963 | Bonnett | 55/463 X |
| 3,178,869 | 4/1965 | Cook | 55/131 X |
| 3,412,530 | 11/1968 | Cardiff | 55/138 X |
| 3,716,966 | 2/1973 | De Seversky | 55/413 X |
| 3,747,300 | 7/1973 | Knudson | 55/138 X |
| 3,936,280 | 2/1976 | Briggs | 55/154 X |

*Primary Examiner*—Kathleen J. Prunner
*Attorney, Agent, or Firm*—Francis J. Bouda

[57] ABSTRACT

An air purifier which includes an air intake with electrically charged plates for ionizing particles of smoke, dust, and impurities entrained in the air, a fan or other air-moving device to move the polluted air through the intake and over the ionizing plates and to discharge the air against a collector which is spaced from the charged plates and is electrically grounded and upon which the ionized pollutants will deposit, and an air outlet through which the purified air can be discharged, leaving the pollutants behind on the collector element.

1 Claim, 4 Drawing Figures

AIR PURIFIER

This application is a continuation-in-part of my copending application Ser. No 840,915, filed Oct. 11, 1977 now abandoned.

BACKGROUND OF THE INVENTION

Electrostatic precipators in general are not new, nor is the principle for clarifying air by the use of electrostatic precipitators.

Such prior precipitators or air purifiers have, however, in the past, been fairly large, expensive, and cumbersome, not portable, and usually constructed for permanent installation in a built-in air conduit. This rendered the device relatively limited in its operation or required the purchase of multiple units for use in different areas of the air ducts.

SUMMARY OF THE INVENTION

In the present invention, I provide a housing which may be portable or transportable (i.e., rolled about on wheels, since this device is small enough to pass through doorways). The housing has a chimney-like portion extending upwardly toward the ceiling of the room and through which the contaminated air is drawn into the body of the container, in which body the pollutants are removed, and from which body clean air is discharged in the room. The structure is mounted on casters and can be rolled about from room to room. Because warm, polluted air accumulates near the ceiling of a room, this device affectively collects the polluted air at the top of the chimney and discharges clean air at floor level (where it is needed by the occupants of the room) without mixing the clean and the polluted air.

Thus a principle object of the present invention is to provide a portable air purifier which is inexpensive and effective and which can be moved from room to room as the need arises.

A further object of the present invention is to provide an air purifier which draws polluted warm air from near the ceiling of the room, passing it through the purifier and discharging it as clean air at floor level.

Another object of the present invention is to provide a purifier which has disposable collector plates so that the maintenance and cleaning of the equipment is easy and inexpensive.

A further object of the present invention is to provide an air purifier wherein the ionizing plates are spaced a substantial distance from the collector plates.

Another object of the present invention is to provide a new and novel electrostatic air purifier.

With the above and other objects in view, a more complete understanding of the present invention can be achieved by referring to the following detailed description.

DETAILED DESCRIPTION

For the purpose of illustrating the invention, there are shown in the accompanying drawings forms thereof which are at present preferred, although it is to be understood that the various instrumentalities of which the invention consists can be variously arranged and organized and that the invention is not limited to the precise arrangements and organizations of the instrumentalities as herein shown and described.

In the drawings wherein like reference characters indicate like parts:

In the purifier of the present invention, I provide a housing or container 10 which is a generally box-like structure supported on wheels 11 to permit the purifier to be moved from room to room. The dimensions of the body 10 are such that the structure can easily pass through a standard doorway which is approximately 30" wide.

Figure 1:
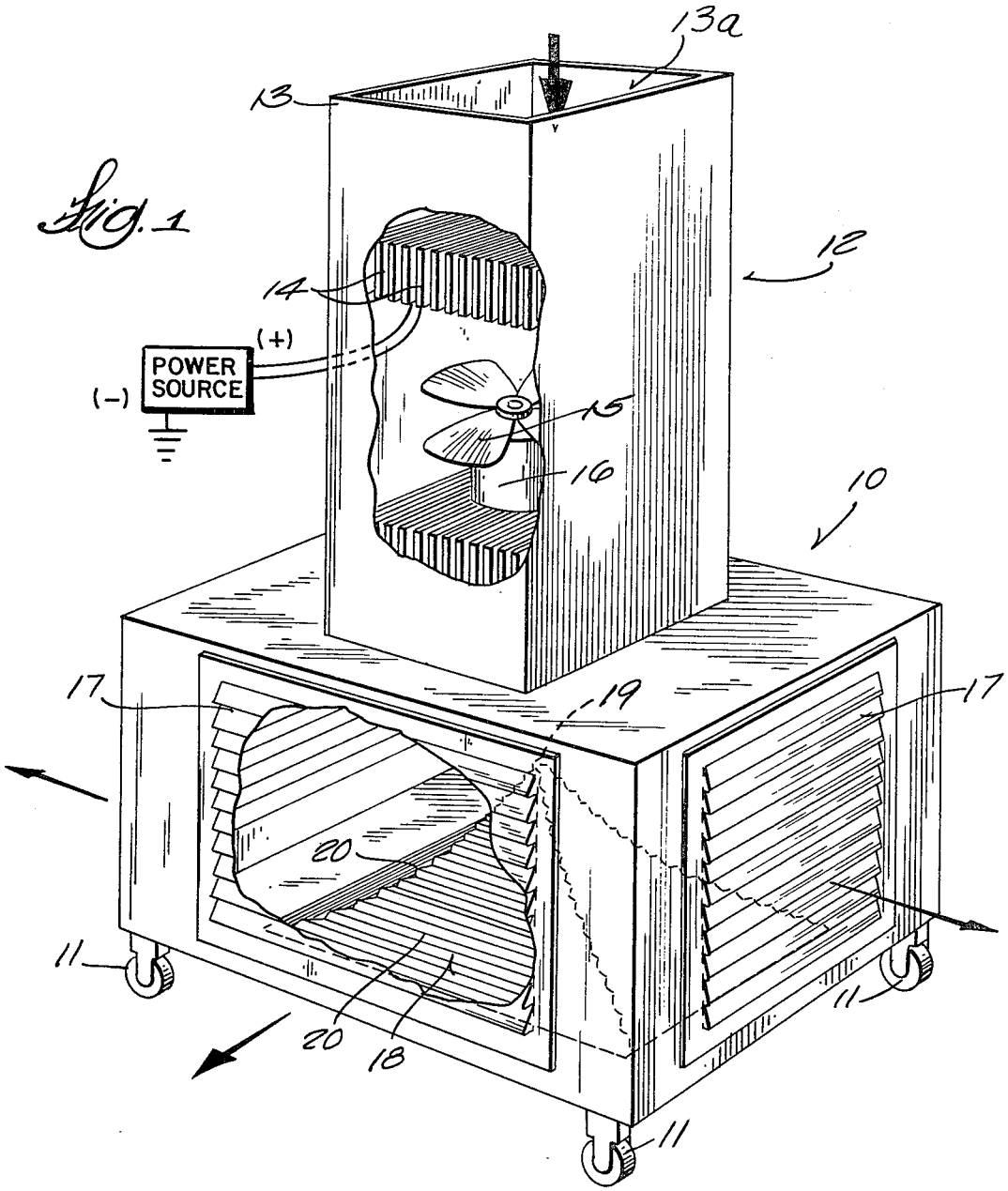
FIG. 1 is a perspective view of one embodiment of the purifier of the present invention, portions of the housing being removed to show the details of the interior.

At the top of the body 10, there is a chimney-like structure 12 which extends upwardly and which terminates in an upper end 13 having an air-intake opening 13-*a*. As shown in FIG. 1, this may be a fixed structure but alternatively it can be telescopic so that the upper end 13 can be elevated closely adjacent the ceiling of the room whereby to draw into the upper end the greatest concentration of warm, polluted air.

Within the chimney 12 a plurality of ionizing plates 14 are disposed which are appropriately energized electrically and which are placed in such a manner that the polluted air passes over the plates and any pollutants entrained in the air will be ionized with a positive charge by the electrical charges on such plates. The construction of such plates is known in the art.

A fan 15 with motor 16 is disposed adjacent the ionizing plates 14 in the chimney 12 so as to draw the polluted air downwardly through the chimney, over and past the ionizing plates 14, and through the passageway 25 into the body 10.

The fan, ionizing plates, and electrical construction can all be mounted on a slide-in tray (not shown) in the chimney 12 for easy installation and servicing.

The body 10 is preferably an open container with louvers or grills 17 on all four sides. Thus, though the air is drawn at relatively high velocity into the smaller upper end opening 13-*a* of the chimney 12, the discharge of such indrawn air through the larger louvers 17 on all four lower sides of the body 10 is at a much slower velocity so that no "draft" or turbulence is created (even though one of the sides of body 10 may be disposed adjacent a wall of the room) so as to prevent any of the clean air mixing with the polluted air.

Figure 4:
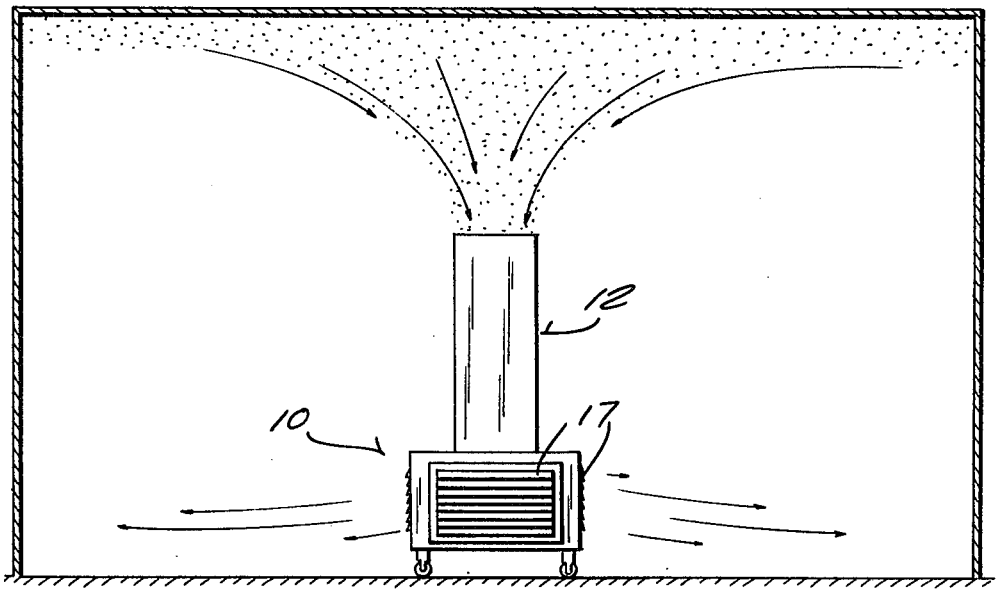
FIG. 4 is a diagrammatical sketch illustrating how the are purifier of the present invention operates within a room.

The arrangement of air intake at ceiling level and air discharge at floor level eliminates mixing the polluted and clean air, as shown in FIG. 4, thus insuring that only non-polluted air is discharged at the level of the occupants of the room.

As shown in FIG. 1, inside the body 10, at the bottom, a generally pyramidal diffuser, or collectorplate 18, is placed. This collector plate is electrically grounded with a negative charge and the apex 19 is disposed directly beneath the chimney 12. The polluted air is blown downwardly by the fan 15 against the diffuser whereby the ionized particles collect on the diffuser plate and adhere thereto. The sloping surfaces 20 of the diffuser 18 direct the clean air to all four sides of the container so that the clean air will pass outwardly through the openings provided by the louvers 17 which openings have a total area substantially greater than the opening 13-*a* at the top of the chimney.

Figure 2:
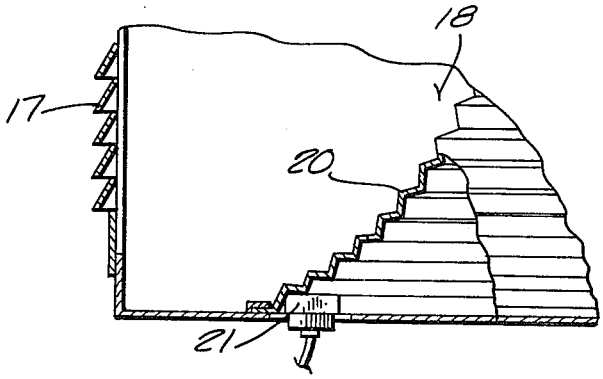
FIG. 2 represents a vertical cross sectional veiw of the diffuser and collector plate used in the purifier of the present invention shown in FIG. 1.

The diffuser 18 is constructed of inexpensive, discardable, corrugated aluminum as shown in FIG. 2 with a wire or similar electrical connection 21 affixed thereto for grounding and for easy replacement.

The diffuser and collector plate is inexpensive and can be thrown away rather than cleaned. Its conical and corrugated construction provide the necessary rigidity and support and make it easy to handle and replace, without increasing the cost, and thus enhance the characteristics of the air purifier of the present invention by eliminating one of the most bothersome aspects of prior air cleaners.

Figure 3:
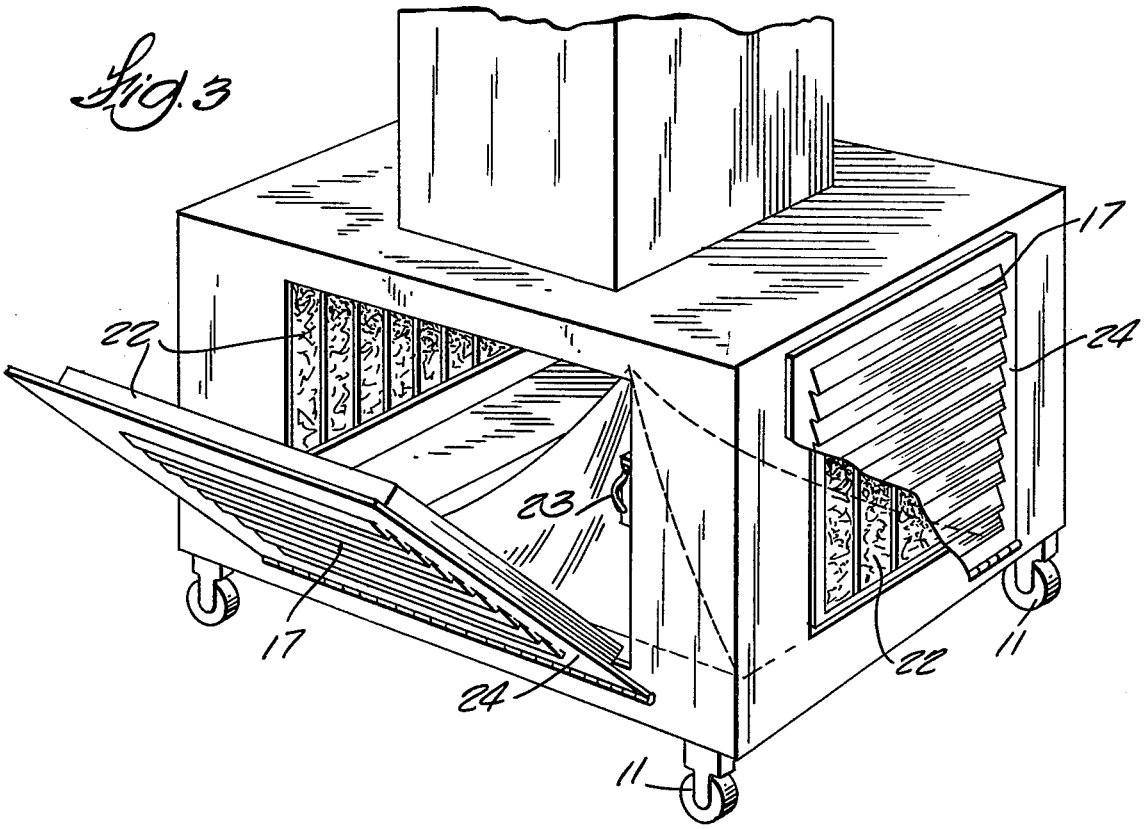
FIG. 3 is a perspective view of another embodiment, showing the collector plates mounted against the discharge opening.

In an alternative embodiment shown in FIG. 3, the diffuser-collector 18 can be replaced by a similar non-electrical baffle or air-guide 26 which may be permanently installed to direct the air toward the louvers 17.

In this embodiment, a separate metallic filter 22 is mounted in the body 10 adjacent each opening provided by the louvers 17 with appropriate connections 23 which permit grounding. These collectors attract the ionized pollutant particles and retain them on the filter, permitting the clean air to pass through the louvers into the room. The louvers 17 may be part of tiltable doors 24 so that the filters 22 can be mounted inside the doors 24 for easy replacement. When the doors are closed, the metallic frame of the filter 22 contacts the grounding connection 23 to complete the electrical circuit of which the metallized collector-filter is a part.

Additional metallic filters, humidifiers, or dehumidifying devices (not shown) can be placed within the body 10 adjacent to the inner side of the grills 17 so that the purified air (from which the ionized particles have been removed) can still be further treated to remove odors and moisture which cannot be electrostatically collected and precipitated on the diffuser plate 18. These elements may include charcoal, paper, high efficiency or any equivalent mechanical filters to remove small, micron size particles in combination with the electrostatic elements described herein.

It is to be understood that the present device may be embodied in other specific forms without departing from the spirit or essential attributes thereof, and it is, therefore, desired that the present embodiments be considered in all respects, as illustrative and, therefore, not restrictive, reference being made to the appended claims rather than to the foregoing description to indicate the scope of the invention.

Having thus described my invention what I claim as new and desire to protect by letters patent are the following:

1. An air purifier consisting of a body, a chimney extending above the body and connected thereto, a passageway between the body and the chimney, an air-intake opening at the top of the chimney, an air-moving fan disposed in the chimney for drawing air and particles entrained therein through said chimney and moving the air and particles through the chimney, passageway and body, an ionizing member disposed in said chimney, electrical means operatively connected to the ionizing member for creating a positive charge on the ionizing member whereby to create a positive charge on any particles moved through said ionizing member by said air-moving fan, at least one collector disposed within the body at a distance from the ionizing member, the collector being electrically grounded, at least one discharge opening in the body, the discharge opening having a total area substantially greater than the area of the air-intake opening, the collector being a lightweight, corrugated, metallic, multi-sided cone with sloping sides to direct the air from the chimney and passageway to the discharge opening.

* * * * *